US010682271B2

(12) United States Patent
Lin

(10) Patent No.: US 10,682,271 B2
(45) Date of Patent: Jun. 16, 2020

(54) ELECTRIC-ASSISTED LEISURE LIFTING RECLINER

(71) Applicant: Chang-Chen Lin, Tainan (TW)

(72) Inventor: Chang-Chen Lin, Tainan (TW)

( * ) Notice: Subject to any disclaimer, the term of this patent is extended or adjusted under 35 U.S.C. 154(b) by 85 days.

(21) Appl. No.: 16/136,394

(22) Filed: Sep. 20, 2018

(65) Prior Publication Data

US 2020/0069489 A1 Mar. 5, 2020

(30) Foreign Application Priority Data

Aug. 31, 2018 (TW) ..... 107211929

(51) Int. Cl.
*A61G 5/14* (2006.01)
*A47C 1/024* (2006.01)
*A47C 7/50* (2006.01)

(52) U.S. Cl.
CPC ..... *A61G 5/14* (2013.01); *A47C 1/0242* (2013.01); *A47C 7/5068* (2018.08)

(58) Field of Classification Search
CPC ..... A61G 5/14; A47C 7/5068; A47C 1/0242; A47C 1/035
USPC ..... 297/330, 76, 85 L
See application file for complete search history.

(56) References Cited

U.S. PATENT DOCUMENTS 4,365,836 A * 12/1982 Jackson ..... A47C 1/03211 297/330
7,543,885 B2 6/2009 Pollard et al.
8,308,228 B2 * 11/2012 Lawson ..... A47C 1/035 297/330
8,366,193 B2 * 2/2013 Lin ..... A47C 3/0255 297/258.1
8,403,409 B2 * 3/2013 Pollard ..... A47C 1/0355 297/85 M
9,022,473 B2 * 5/2015 Crum ..... A47C 7/54 297/259.2
9,351,574 B2 * 5/2016 Lin ..... A47C 1/0355
9,402,479 B1 * 8/2016 Lin ..... A47C 1/0355
2011/0175404 A1 * 7/2011 Lawson ..... A47C 1/0355 297/83
2013/0175847 A1 * 7/2013 Lawson ..... A61G 5/14 297/85 M
2019/0350362 A1 * 11/2019 Lapointe ..... A47C 7/5068

* cited by examiner

*Primary Examiner* — Mark R Wendell
(74) *Attorney, Agent, or Firm* — Alan D. Kamrath; Mayer & Williams PC

(57) ABSTRACT

An electric-assisted leisure lifting recliner includes a back frame pivotably mounted to a seat frame unit. A footrest unit includes a connecting portion pivotably connected to a front end of the seat frame unit. First and second frames are pivotably connected to a base unit and the seat frame unit and are operable to move the seat frame unit vertically. A telescopic rod is pivotably connected to an actuating block and the connecting portion. An actuator pivotably connected to the actuating block can move the footrest unit to an extended state and to recline the back frame. When the connecting portion abuts against the seat frame unit, the telescopic rod can be shortened to independently recline the back frame. When a length of the actuator is shortened, the first and second frames and the seat frame unit are lifted, and a rear end of the seat frame rises.

9 Claims, 8 Drawing Sheets

ELECTRIC-ASSISTED LEISURE LIFTING RECLINER

BACKGROUND OF THE INVENTION

The present invention relates to an electric-assisted leisure lifting recliner and, more particularly, to an electric-assisted leisure lifting recliner operated by a single actuator while providing enhanced operational convenience, stability, and comfort.

A type of chair includes a seat for supporting the buttocks of a user and a backrest for supporting the back of the user. To provide comfort support for the legs, a telescopic footrest can be disposed in front of the seat. Furthermore, the reclining angle of the backrest can be adjusted to provide sitting comfort.

To help the user leave the chair, a lifting mechanism is provided in currently available chairs to lift the center of gravity of the buttocks of the user by raising a rear end of the chair while the user moves forwards to leave the seat for the purposes of standing up.

U.S. Pat. No. 7,543,885 discloses a lift chair and recliner including an actuator for adjusting the reclining angle of a back frame. A footrest moves to an extended state while the back frame reclines. Another actuator lifts a rear end of the seat to help a user stand up. However, the two actuators increases the costs. Furthermore, when the user merely intends to extend the footrest for reading or eating without significantly reclining the backrest, the lift chair and recliner cannot fulfill this need and, thus, provides limited applications.

Although the lift chair and recliner could be designed to include only one actuator for controlling the reclining angle of the backrest and lifting the seat, the resulting components could be complicated and could have poor stability.

BRIEF SUMMARY OF THE INVENTION

An objective of the present invention is to provide an electric-assisted leisure lifting recliner operated by a single actuator while providing enhanced operational convenience, stability, and comfort.

An electric-assisted leisure lifting recliner according to the present invention includes a seat frame unit mounted on top of a base unit and including a seat frame and a chassis mounted below the seat frame. A stopper portion is provided on a front end of the seat frame. A back frame unit is mounted to a rear end of the seat frame unit and includes a back frame and a first linking rod. The back frame includes a lower end pivotably connected to a rear end of the seat frame. The first linking rod includes an end pivotably connected to the lower end of the back frame. A footrest unit is movable between an extended state and a folded state. The footrest unit includes a connecting portion and a supporting portion. The connecting portion is pivotably connected to a front end of the seat frame unit and includes an abutting end. When the footrest unit is in the extended state, the connecting portion is located behind the supporting portion, and the abutting end abuts against the stopper portion of the seat frame. An interlocking unit includes a first frame, a second frame, an actuating block, and a telescopic rod. The first frame includes front and rear ends pivotably connected to the base unit and the chassis, respectively. The second frame includes front and rear ends pivotably connected to the base unit and the chassis, respectively. The first frame and the second frame are operable to move the seat frame unit upward or downward relative to the base unit. The actuating block is pivotably connected to the first linking rod, the seat frame unit, the second frame, and the telescopic rod. The telescopic rod is telescopic and includes two ends pivotably connected to the actuating block and the connecting portion of the footrest unit, respectively. An actuator includes a first end pivotably connected to the actuating block. The actuator is extendible to move the footrest unit to the extended state and to recline the back frame. When the abutting end of the connecting portion of the footrest unit abuts against the stopper portion of the seat frame, a length of the telescopic rod is capable of being shortened to independently recline the back frame. When a length of the actuator is shortened, the first and second frames and the seat frame unit are lifted, and the rear end of the seat frame rises.

In an example, the interlocking unit further includes a pull cord device having a drum and a cord. The drum is mounted to the seat frame unit. The cord is wound around the drum and is movable in a winding direction and an unwinding direction. The cord includes an end coupled to a front end of the supporting portion of the footrest unit.

In an example, the telescopic rod includes an outer tube and an inner rod received in the outer tube, and an end of the inner rod is received in the outer tube and is actuatable by a gas pressure or a spring to telescope relative to the outer tube.

In an example, the base unit includes a transverse beam parallel to a ground. The transverse beam includes two sides. Each of the two sides of the transverse beam has a first pivotal portion and a second pivotal portion below the first pivotal portion. The front end of the seat frame includes a third pivotal portion and a fourth pivotal portion. Two fifth pivotal portions are provided on two sides of the rear end of the seat frame. A sixth pivotal portion is disposed on an intermediate portion of the rear end of the seat frame. The chassis are fixed to two sides of the seat frame and includes two lateral sides. Each of the two lateral sides includes a seventh pivotal portion and an eighth pivotal portion below the seventh pivotal portion. Two side boards are respectively provided on two sides of a lower end of the back frame. Each of the two side boards includes a front end having a ninth pivotal portion pivotably connected to a respective one of the two fifth connecting portions of the seat frame. A tenth pivotal portion is provided on an in intermediate portion of a lower end of the back frame. The first linking rod includes a rear end having an eleventh pivotal portion and a front end having a twelfth pivotal portion. The eleventh pivotal portion is pivotably connected to the tenth pivotal portion of the back frame.

In an example, the connecting portion of the footrest unit includes a frame and two second linking rods. A thirteenth pivotal portion and a fourteenth pivotal portion are disposed on a rear end of the frame. The fourteenth pivotal portion is pivotably connected to the fourth pivotal portion of the seat frame. Each of the two second linking rods includes two ends respectively and pivotably connected to the third pivotal portion and the supporting portion. The supporting portion includes a linking unit having a rear end pivotably connected to the second linking rod of the connecting portion. When the footrest unit is in the folded state, the connecting portion and the supporting portion are located below the chassis. When the footrest unit is in the extended state, the connecting portion and the supporting portion are located in front of the seat frame.

In an example, two fifteenth pivotal portions are provided on a rear end of the first frame. Two sixteenth pivotal portions are provided on a front end of the first frame. Each of the two fifteenth pivotal portions is pivotably connected to a respective first pivotal portion of the base unit. Each of the two sixteenth pivotal portions is pivotably connected to a respective seventh pivotal portion. Two seventeenth pivotal portions are provided on a rear end of the second frame. Two eighteenth pivotal portions are provided on a front end of the second frame. Each of the two seventeenth pivotal portions is pivotably connected to a respective second pivotal portion. Each of the two eighteenth pivotal portions is pivotably connected to a respective eighth pivotal portion of the chassis.

In an example, the second frame further includes a nineteenth pivotal portion. The actuating block is mounted below the seat frame unit and in front of the first and second frames. A twentieth pivotal portion is provided on a rear end of the actuating block. A twenty-first pivotal portion, a twenty-second pivotal portion, and a twenty-third pivotal portion are provided on a front end of the actuating block and are arranged from top to bottom in sequence. The twentieth pivotal portion is pivotably connected to the twelfth pivotal portion of the first linking rod of the back frame unit. The twenty-third pivotal portion is pivotably connected to the nineteenth pivotal portion of the second frame. An end of the telescopic rod is pivotably connected to the twenty-first pivotal portion of the actuating block. Another end of the telescopic rod is pivotably connected to the thirteenth pivotal portion.

In an example, the actuator further includes a second end pivotably connected to the sixth pivotal portion of the seat frame, and the first end of the actuator is pivotably connected to the twenty-second pivotal portion of the actuating block.

In an example, each of the two sides of the seat frame includes a peg on a rear end thereof, and each of the two side boards of the back frame includes an arcuate slot receiving a respective peg.

Before the rear end of the seat frame unit is raised, the extended length of the actuator can be set to fix the angular position of the actuating block while assuring that the footrest unit will not extend and that the rear end of the seat frame unit will not raise. At this time, the telescopic rod has an extended length, and the cord of the pull cord device can pull the supporting portion of the footrest unit to fold, providing a better folding effect.

when the actuator is extended, the actuating block moves upward and forward to carry the telescopic rod forward and to extend the footrest unit. At this time, the back frame can move slightly rearward. Furthermore, the abutting end at the rear end of the footrest unit abuts against the stopper portion of the seat frame unit to restrain the maximum extended angle of the footrest unit. Thus, when the footrest unit is extended, the back frame will not excessively recline, such that the user can rest his or her feet while reading or doing other work.

When the actuator continues to extend, the rear end of the actuating block moves upward to move the first linking rod and to recline the back frame. At the same time, the upper end of the front side of the actuating block moves forward and compresses the telescopic rod. As a result, the telescopic rod enables continuous movement of the actuating block as well as normal reclining of the back frame without affecting the footrest unit.

When the user intends to get up, the length of the actuator is shortened to move the actuating block while lifting the front ends of the first and second frames. The first and second frames lift the seat frame unit and raise the rear end of the seat frame unit. Thus, the buttocks of the user can be lifted, and the center of gravity of the user moves forward, allowing the user to get up easily.

The electric-assisted leisure lifting recliner according to the present invention utilizes a single actuator to fold or extend the footrest unit, to adjust the reclining angle of the back frame, and to lift the seat frame unit. The electric-assisted leisure lifting recliner according to the present invention has fewer components while providing better operational stability. Furthermore, the footrest unit and the back frame can move independently to provide convenient reading and lying comfort, thereby providing enhanced use convenience and comfort.

The present invention will become clearer in light of the following detailed description of illustrative embodiments of this invention described in connection with the drawings.

DETAILED DESCRIPTION OF THE INVENTION

Figure 1:
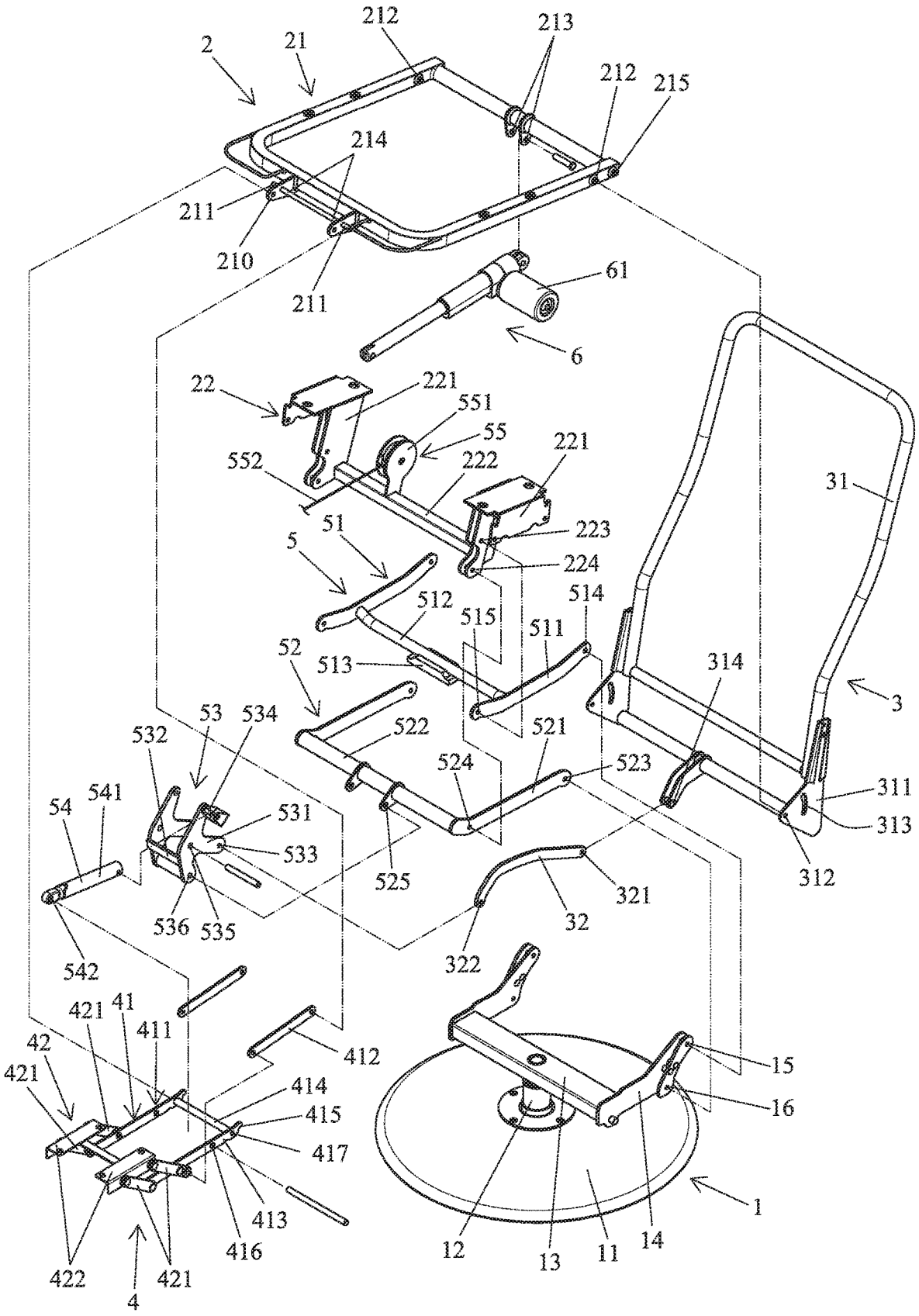
FIG. 1 is an exploded, perspective view of an electric-assisted leisure lifting recliner of an embodiment according to the present invention.
Figure 2:
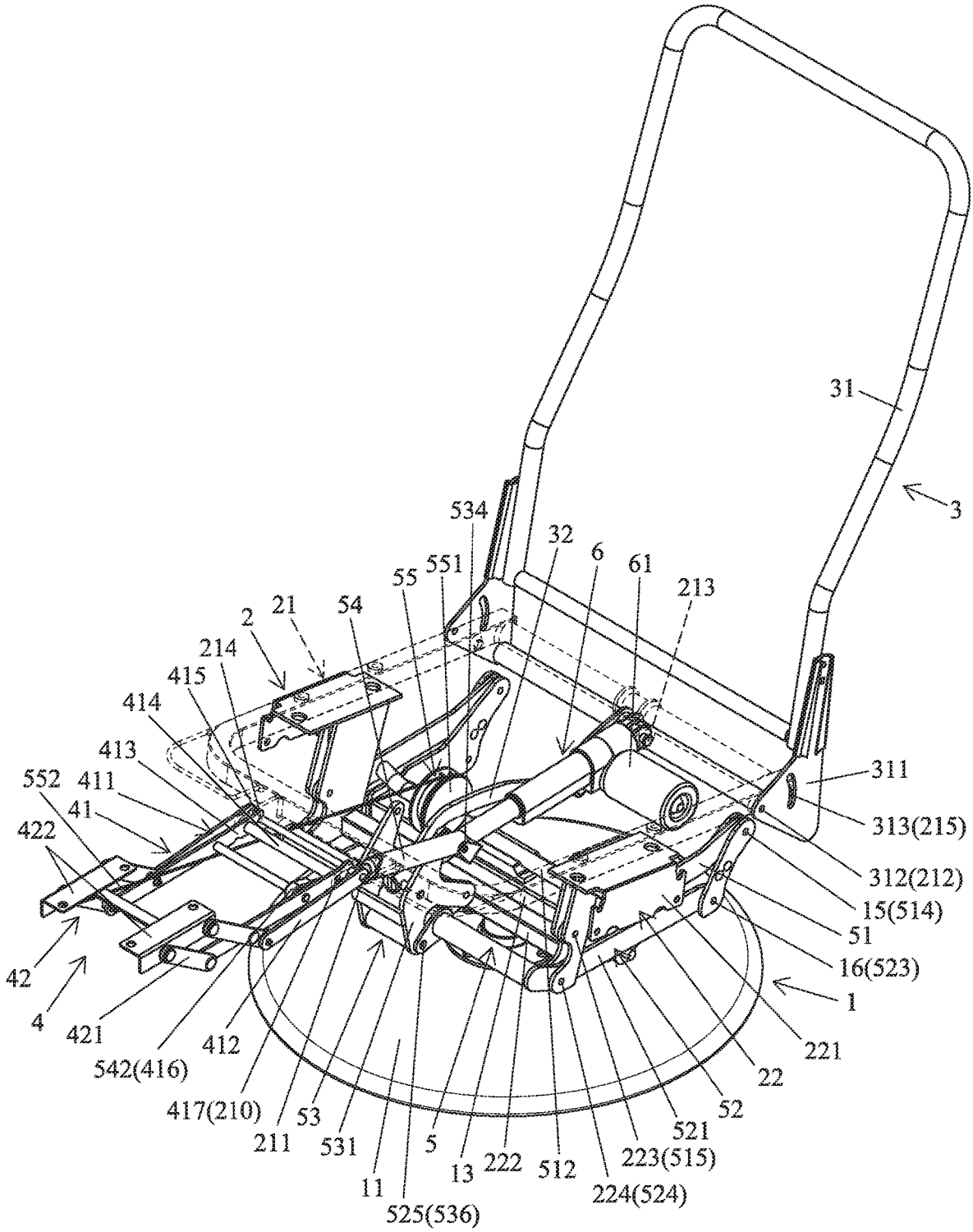
FIG. 2 is a perspective view of the electric-assisted leisure lifting recliner after assembly, with a footrest unit in an extended state.
Figure 3:
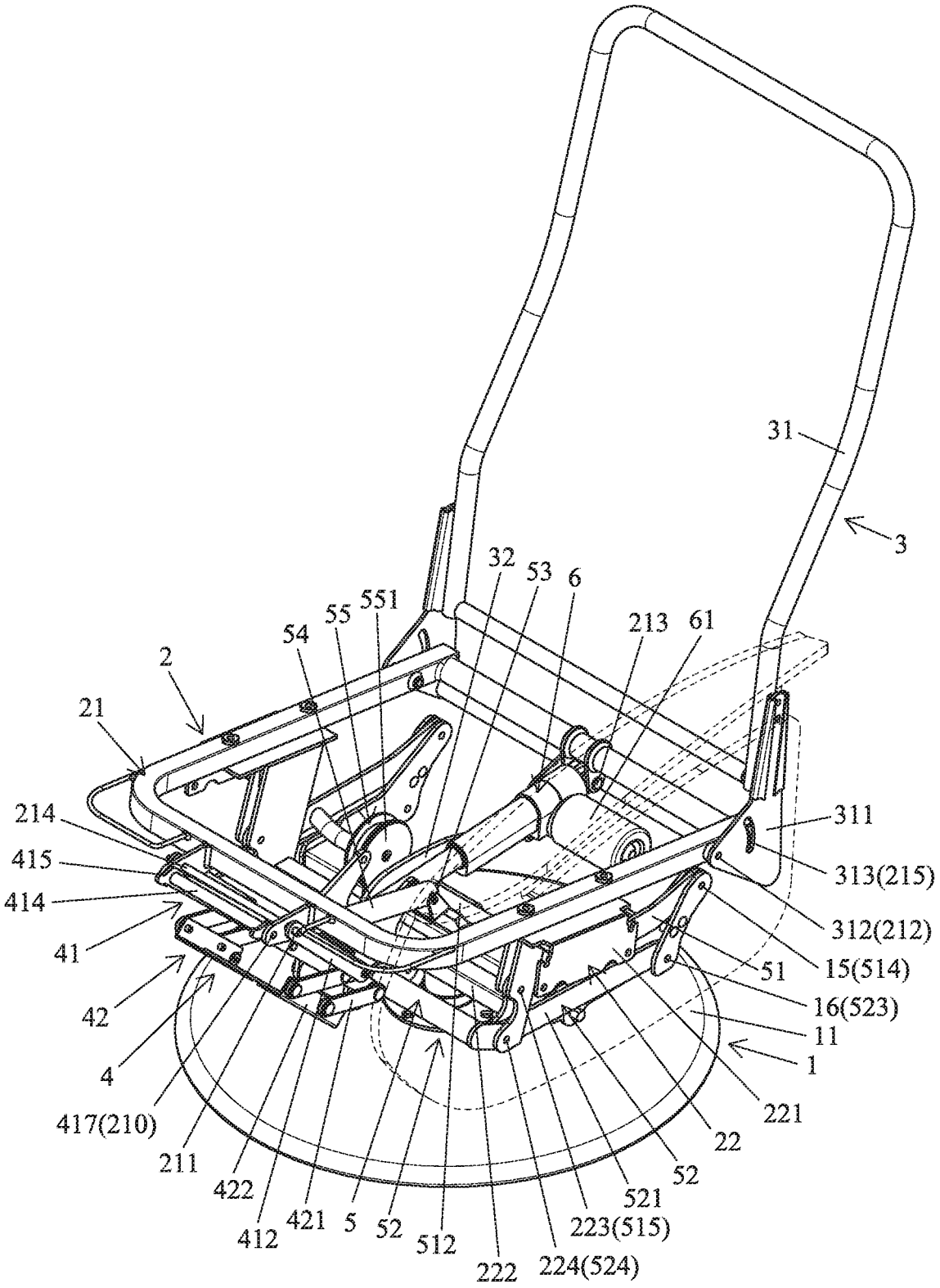
FIG. 3 is a perspective view of the electric-assisted leisure lifting recliner with the footrest unit in a folded state.

With reference to FIGS. 1-4, an electric-assisted leisure lifting recliner of an embodiment according to the present invention includes a base unit 1, a seat frame unit 2, a back frame unit 3, a footrest unit 4, an interlocking unit 5, and an actuator 6. The footrest unit 4 extends in a forward/rearward direction when moving an extended state. The base unit 1 includes a base 11 having a post 12 at a central portion thereof. A transverse beam 13 is mounted on top of the post 12 and extends parallel to the ground. Two coupling boards 14 are respectively mounted to two sides of the transverse beam 13. Each of the two sides of the transverse beam 13 has a first pivotal portion 15 and a second pivotal portion 16 below the first pivotal portion 15.

The seat frame unit 2 includes a seat frame 21 and a chassis 22. The seat frame 21 is substantially square in cross section, extends substantially parallel to the ground, and is configured for sitting purposes. A front end of the seat frame 21 includes a third pivotal portion 211 and a fourth pivotal portion 210. Two fifth pivotal portions 212 are provided on two sides of the rear end of the seat frame 21. A sixth pivotal portion 213 is disposed on an intermediate portion of the rear end of the seat frame 21. A stopper portion 214 is provided on the front end of the seat frame 21 and is located adjacent to the third pivotal portion 211. Each of the two sides of the seat frame 21 includes a peg 215 on a rear end thereof. The chassis 22 is mounted below the seat frame 21 and includes two side boards 221 forming two lateral sides of the chassis 22 and having upper and lower ends fixed to the two sides of the seat frame 21, respectively. A first transverse rod 222 extends between intermediate portions of the two side boards 221. Each of the two side boards 221 includes a seventh pivotal portion 223 and an eighth pivotal portion 224 below the seventh pivotal portion 223.

The back frame unit 3 includes a back frame 31 and a first linking rod 32. Two side boards 311 are respectively provided on two sides of a lower end of the back frame 31. Each of the two side boards 311 includes a front end having a ninth pivotal portion 312 pivotably connected to a respective one of the two fifth connecting portions 212 of the seat frame 21. Each of the two side boards 311 of the back frame 31 further includes an arcuate slot 313 receiving a respective peg 215. A tenth pivotal portion 314 is provided on an in intermediate portion of a lower end of the back frame 31. The first linking rod 32 includes a rear end having an eleventh pivotal portion 321 and a front end having a twelfth pivotal portion 322. The eleventh pivotal portion 321 is pivotably connected to the tenth pivotal portion 314 of the back frame 31.

The footrest unit 4 is a multi-linkage mechanism and is movable between an extended state and a folded state. The footrest unit 4 includes a connecting portion 41 and a supporting portion 42. The connecting portion 41 of the footrest unit 4 includes a frame 411 and two second linking rods 412. The frame 411 includes two plates 413 parallel to each other and a second linking rod 414 interconnected between the two plates 413. A rear end of each of the two plates 413 includes an abutting end 415 that is hooked. When the footrest unit 4 is in the extended state, the connecting portion 41 is located behind the supporting portion 42, and the abutting ends 415 abuts against the stopper portion 214 of the seat frame 21. A thirteenth pivotal portion 416 and a fourteenth pivotal portion 417 are disposed on rear ends of the two plates 413. The fourteenth pivotal portion 417 is pivotably connected to the fourth pivotal portion 210 of the seat frame 21. Each of the two second linking rods 412 includes two ends respectively and pivotably connected to the third pivotal portion 211 of the seat frame 21 and the supporting portion 42. The two second linking rods 412 interlock with the connecting portion 41 and the supporting portion 42.

In this embodiment, the supporting portion 42 includes a linking unit comprised of four connecting rods 421 and two supporting rods 422. Each of the four connecting rods 421 includes two ends pivotably connected to the front end of the frame 411 and a respective one of the two supporting rods 422, respectively. A rear end of the linking unit is pivotably connected to the two second lining rods 412. When the footrest unit 4 is in the folded state, the connecting portion 41 and the supporting portion 42 are located below the chassis 21. On the other hand, when the footrest unit 4 is in the extended state, the connecting portion 41 and the supporting portion 42 are located in front of the seat frame 21, and the two supporting rods 422 are located above the four connecting rods 421.

The interlocking unit 5 includes a first frame 51, a second frame 52, an actuating block 53, a telescopic rod 54, and a pull cord device 55. The first frame 51 includes two plates 511 parallel to each other and a third transverse rod 512 interconnected between intermediate portions of the two plates 511. An abutting board 513 is mounted to a bottom of the third transverse rod 512 and is configured to abut against the transverse beam 13 of the seat unit 1. Two fifteenth pivotal portions 514 are respectively provided on rear ends of the two side plates 511 of the first frame 51. Two sixteenth pivotal portions 515 are respectively provided on front ends of the two plates 511 of the first frame 51. Each of the two fifteenth pivotal portions 514 is pivotably connected to a respective first pivotal portion 15 of the base unit 1. Each of the two sixteenth pivotal portions 515 is pivotably connected to a respective seventh pivotal portion 223 of the chassis 22.

The second frame 52 includes two plates 521 parallel to each other and a fourth transverse rod 522 interconnected between intermediate portions of the two plates 521. Two seventeenth pivotal portions 523 are respectively provided on rear ends of the two plates 521 of the second frame 52. Two eighteenth pivotal portions 524 are respectively provided on front ends of the two plates 521 of the second frame 52. Each of the two seventeenth pivotal portions 523 is pivotably connected to a respective second pivotal portion 16 of the base unit 1. Each of the two eighteenth pivotal portions 524 is pivotably connected to a respective eighth pivotal portion 224 of the chassis 22. The second frame 52 further includes a nineteenth pivotal portion 525 at an intermediate portion of the fourth transverse rod 502.

The actuating block 53 is mounted below the seat frame unit 2 and is located in front of the first frame 51 and the second frame 52. The actuating block 53 includes two plates 531 parallel to each other and a fifth transverse rod 532 interconnected between intermediate portions of the two plates 531. A twentieth pivotal portion 533 is provided on rear ends of the two plates 531 of the actuating block 53. A twenty-first pivotal portion 534, a twenty-second pivotal portion 535, and a twenty-third pivotal portion 536 are provided on front ends of the two plates 531 of the actuating block 53 and are arranged from top to bottom in sequence. The twentieth pivotal portion 533 is pivotably connected to the twelfth pivotal portion 322 of the first linking rod 32. The twenty-third pivotal portion 536 is pivotably connected to the nineteenth pivotal portion 525 of the second frame 52.

The telescopic rod 54 is telescopic and permits non-movement of the footrest unit 4 during a portion of the reclining travel of back frame unit 3. In this embodiment, the telescopic rod 54 includes an outer tube 541 and an inner rod 542 received in the outer tube 541. An end of the inner rod 542 is received in the outer tube 541 and is actuatable by a gas pressure or a spring to telescope relative to the outer tube 541. An end of the telescopic rod 54 is pivotably connected to the twenty-first pivotal portion 534 of the actuating block 53. The other end of the inner tube 542 of the telescopic rod 54 is pivotably connected to the thirteenth pivotal portion 416 of the frame 411 of the footrest unit 4.

The pull cord device 55 includes a drum 551 and a cord 552. The drum 551 is mounted to the first transverse rod 222 of the chassis 22 of the seat frame unit 2. The cord 552 is wound around the drum 551 and is movable in a winding direction and an unwinding direction. The cord 552 includes an end coupled to a front end of the supporting portion 42 of the footrest unit 4, enabling the footrest unit 4 to fold.

The actuator 6 includes a motor 61 that power the actuator 6 to extend or retract. A first end of the actuator 6 is pivotably connected to the twenty-second pivotal portion 535 of the actuating block 53. A second end of the actuator 6 is pivotably connected to the sixth pivotal portion 213 of the seat frame 21. When the footrest unit 4 is not extended and the rear end of the seat frame unit 2 is not raised, the actuator 6 is in an extended state.

For the sake of explanation, it will be assumed that the back frame unit 3 is not reclined and the footrest unit 4 is not extended. Before the rear end of the seat frame unit 2 is raised, the extended length of the actuator 6 can be set to fix the angular position of the actuating block 53 while assuring that the footrest unit 4 will not extend and that the rear end of the seat frame unit 2 will not raise. At this time, the telescopic rod 54 has an extended length, and the cord 552 of the pull cord device 55 can pull the supporting portion 42 of the footrest unit 4 to fold, providing a better folding effect.

Figure 5:
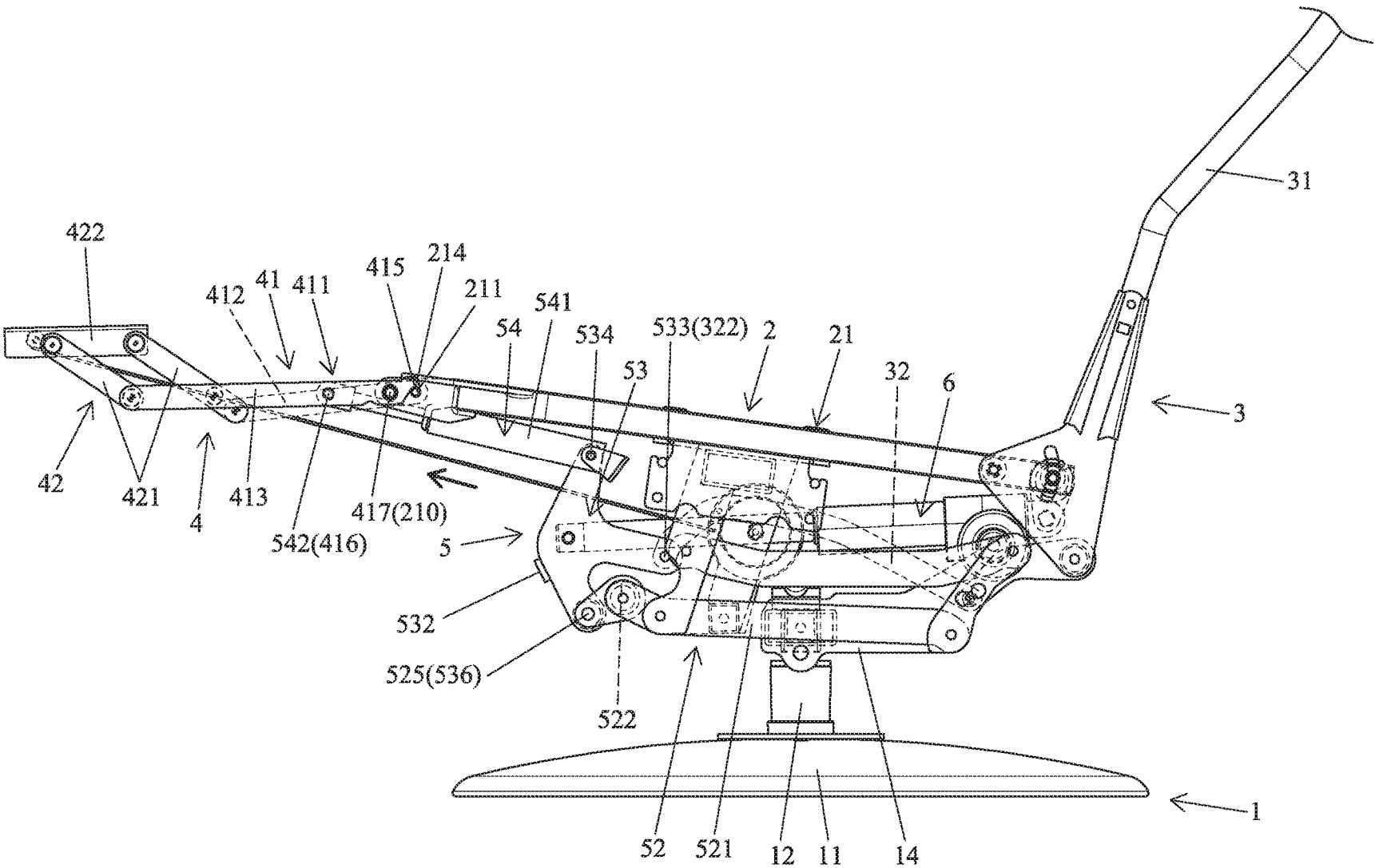
FIG. 5 is a side view of the electric-assisted leisure lifting recliner with a back frame slightly reclined and with the footrest unit in the extended state.

With reference to FIG. 5, when the actuator 6 is extended, the actuating block 53 moves upward and forward to carry the telescopic rod 54 forward and to extend the footrest unit 4. At this time, the back frame 31 can move slightly rearward. Furthermore, the abutting end 415 at the rear end of the footrest unit 4 abuts against the stopper portion 214 of the seat frame unit 2 to restrain the maximum extended angle of the footrest unit 4. Thus, when the footrest unit 4 is extended, the back frame 31 will not excessively recline, such that the user can rest his or her feet while reading or doing other work.

Figure 6:
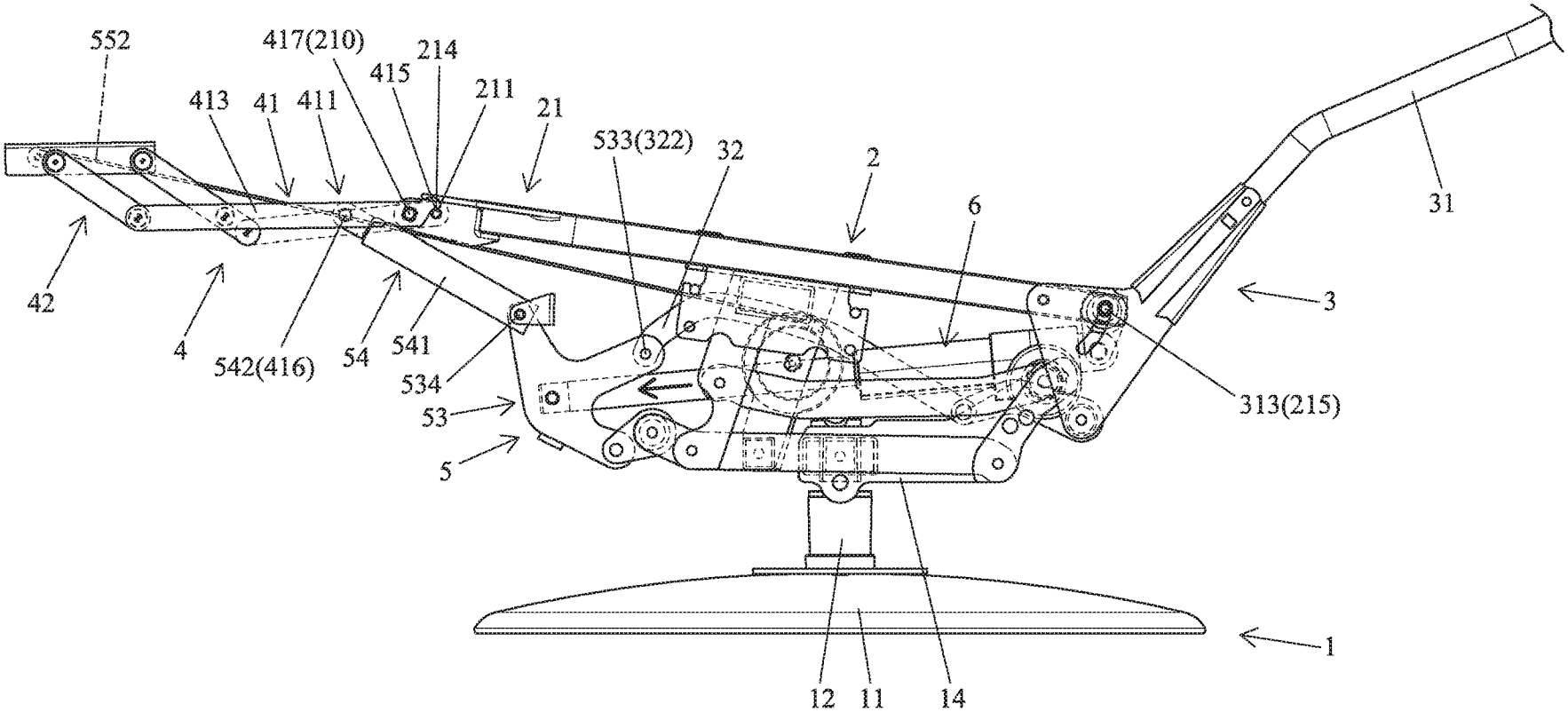
FIG. 6 is a side view of the electric-assisted leisure lifting recliner with the backrest reclined to its maximum angle.

With reference to FIG. 6, when the actuator 6 continues to extend, the rear end of the actuating block 53 moves upward to move the first linking rod 32 and to recline the back frame 31. At the same time, the upper end of the front side of the actuating block 53 moves forward and compresses the telescopic rod 54. As a result, the telescopic rod 54 enables continuous movement of the actuating block 53 as well as normal reclining of the back frame 31 without affecting the footrest unit 4. Furthermore, the back frame unit 3 can disengage from the footrest unit 4. When the back frame 31 reaches a larger reclining angle, the user can lie in an almost horizontal position, providing enhanced lying comfort. When the back frame 31 reclines, the arcuate slots 313 move relative to the pegs 215 of the seat frame 2, providing better movement stability and defining the maximum reclining angle of the back frame 31.

Figure 4:
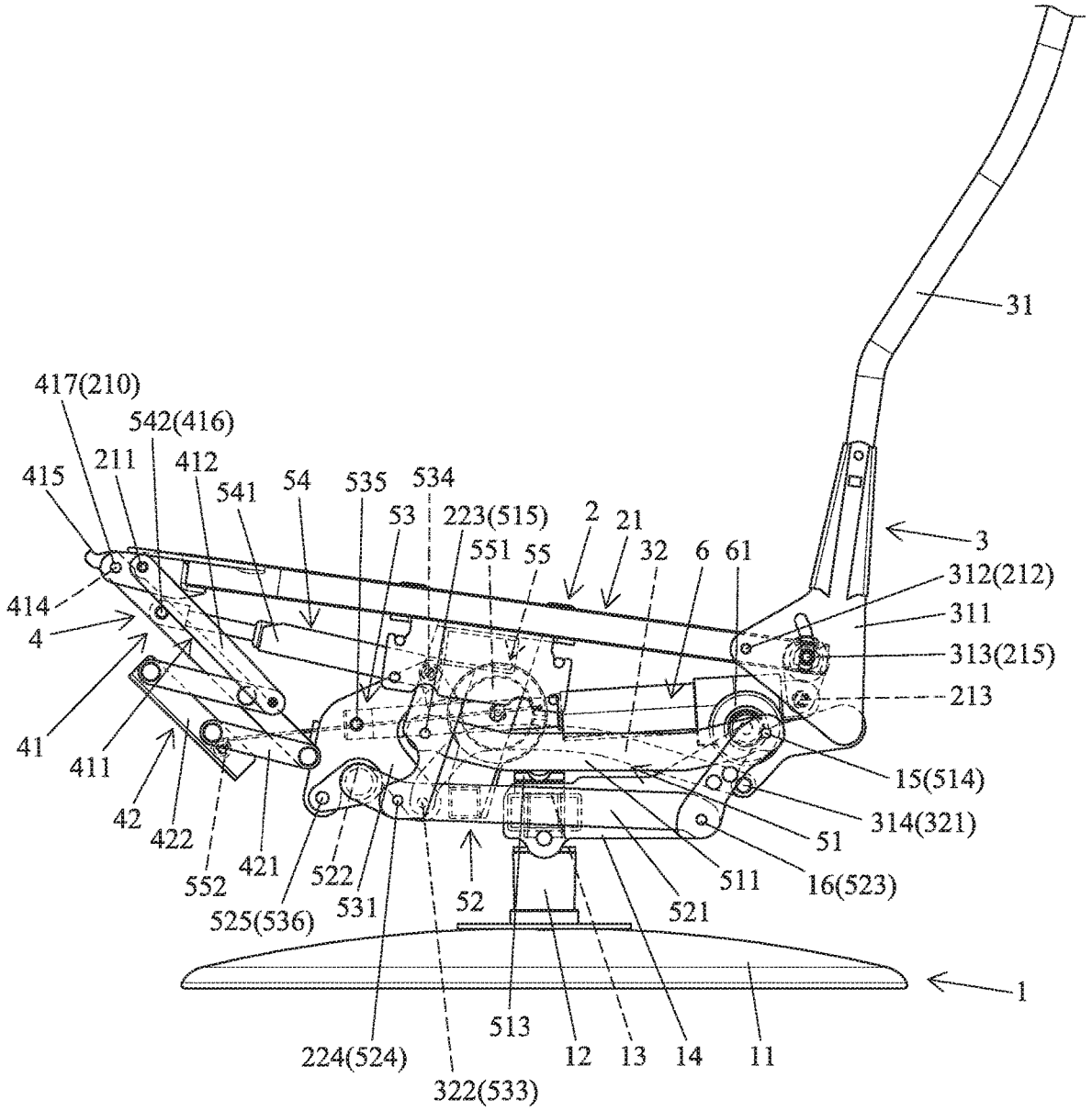
FIG. 4 is a side view of the electric-assisted leisure lifting recliner with the footrest unit in a folded state.

With reference to FIG. 4, when the length of actuator 6 is shortened, the actuating block 53 moves in the reverse direction, the back frame 31 moves toward the vertical position, and the footrest 4 is folded. Furthermore, the cord 552 of the pull cord device 55 pulls the footrest unit 4 to enhance the folding stability.

Figure 7:
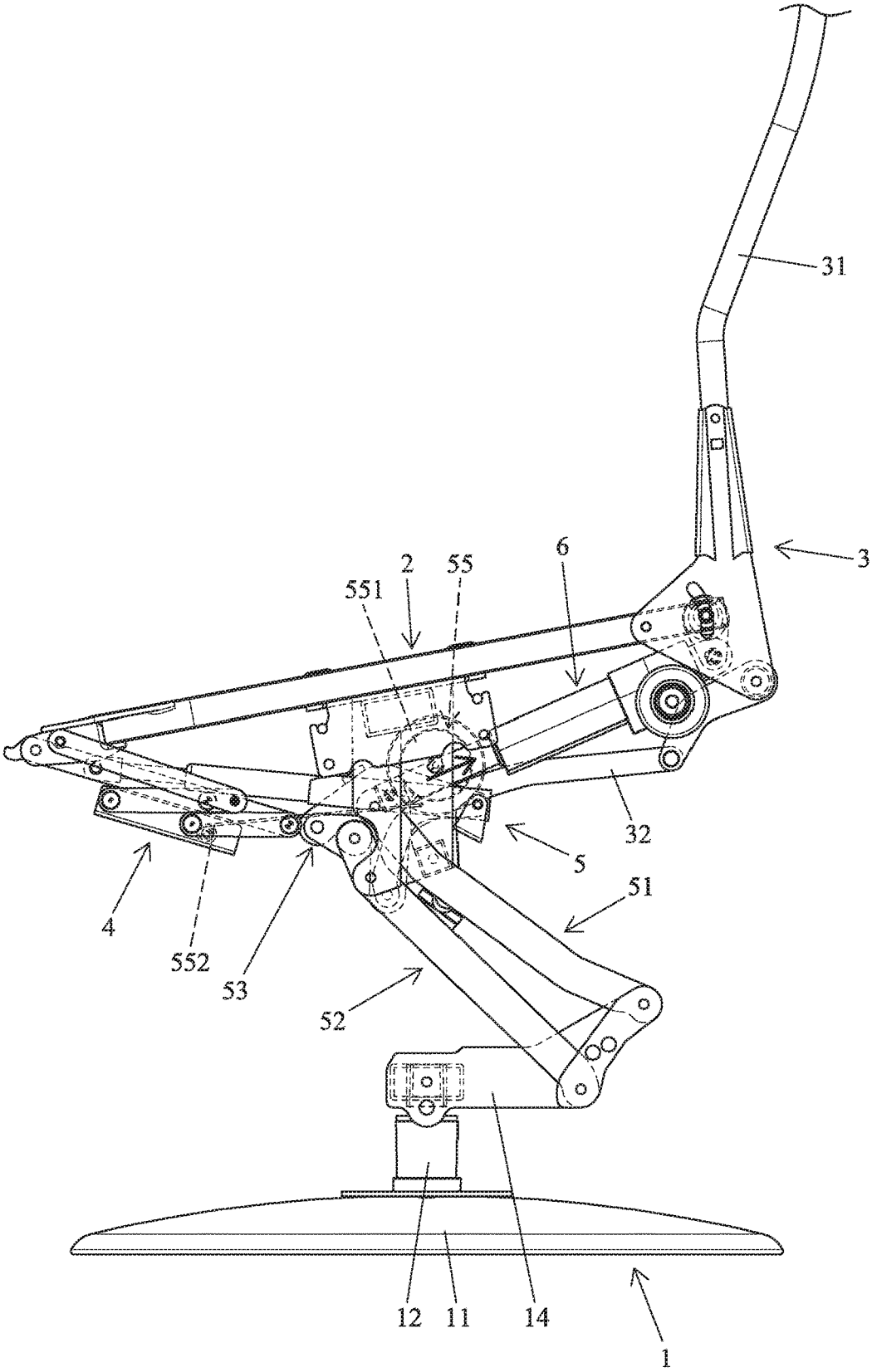
FIG. 7 is a side view of the electric-assisted leisure lifting recliner with a seat frame unit in a lifted state.
Figure 8:
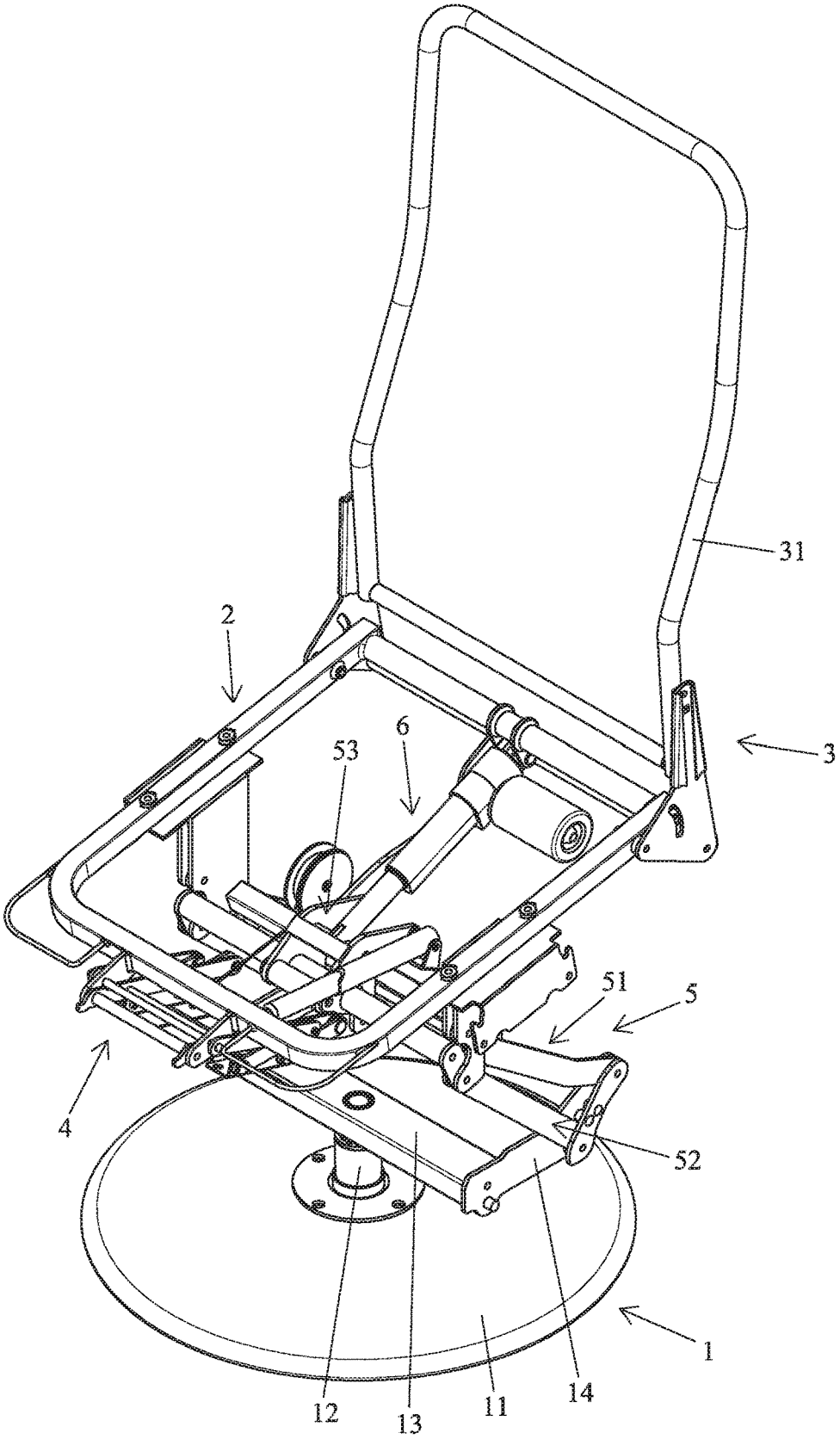
FIG. 8 is a perspective view of the electric-assisted leisure lifting recliner with the seat frame unit in a lifted state.

With reference to FIGS. 7 and 8, when the user intends to get up, the length of the actuator 6 is further shortened to move the actuating block 53 while lifting the front ends of the first and second frames 51 and 52. The first and second frames 51 and 52 lift the seat frame unit 2 and raise the rear end of the seat frame unit 2. Thus, the buttocks of the user can be lifted, and the center of gravity of the user moves forward, allowing the user to get up easily.

In view of the foregoing, the electric-assisted leisure lifting recliner according to the present invention utilizes a single actuator 6 to fold or extend the footrest unit 4, to adjust the reclining angle of the back frame 31, and to lift the seat frame unit 2. The electric-assisted leisure lifting recliner according to the present invention has fewer components while providing better operational stability. Furthermore, the footrest unit 4 and the back frame 31 can move independently to provide convenient reading and lying comfort, thereby providing enhanced use convenience and comfort.

Although specific embodiments have been illustrated and described, numerous modifications and variations are still possible without departing from the scope of the invention. The scope of the invention is limited by the accompanying claims.

The invention claimed is:

1. An electric-assisted leisure lifting recliner comprising:

a base unit;

a seat frame unit mounted on top of the base unit and including a seat frame and a chassis mounted below the seat frame, wherein a stopper portion is provided on a front end of the seat frame;

a back frame unit mounted to a rear end of the seat frame unit and including a back frame and a first linking rod, wherein the back frame includes a lower end pivotably connected to a rear end of the seat frame, and wherein the first linking rod includes an end pivotably connected to the lower end of the back frame;

a footrest unit movable between an extended state and a folded state, wherein the footrest unit includes a connecting portion and a supporting portion, wherein the connecting portion is pivotably connected to a front end of the seat frame unit and includes an abutting end, and wherein when the footrest unit is in the extended state, the connecting portion is located behind the supporting portion, and the abutting end abuts against the stopper portion of the seat frame;

an interlocking unit including a first frame, a second frame, an actuating block, and a telescopic rod, wherein the first frame includes front and rear ends pivotably connected to the base unit and the chassis, respectively, wherein the second frame includes front and rear ends pivotably connected to the base unit and the chassis, respectively, wherein the first frame and the second frame are operable to move the seat frame unit upward or downward relative to the base unit, wherein the actuating block is pivotably connected to the first linking rod, the seat frame unit, the second frame, and the telescopic rod, and wherein the telescopic rod is telescopic and includes two ends pivotably connected to the actuating block and the connecting portion of the footrest unit, respectively; and an actuator including a first end pivotably connected to the actuating block, wherein the actuator is extendible to move the footrest unit to the extended state and to recline the back frame, wherein when the abutting end of the connecting portion of the footrest unit abuts against the stopper portion of the seat frame, a length of the telescopic rod is capable of being shortened to independently recline the back frame, and wherein when a length of the actuator is shortened, the first and second frames and the seat frame unit are lifted, and the rear end of the seat frame rises.

2. The electric-assisted leisure lifting recliner as claimed in claim 1, wherein the interlocking unit further includes a pull cord device having a drum and a cord, wherein the drum is mounted to the seat frame unit, wherein the cord is wound around the drum and is movable in a winding direction and an unwinding direction, and wherein the cord includes an end coupled to a front end of the supporting portion of the footrest unit.

3. The electric-assisted leisure lifting recliner as claimed in claim 1, wherein the telescopic rod includes an outer tube and an inner rod received in the outer tube, and wherein an end of the inner rod is received in the outer tube and is actuatable by a gas pressure or a spring to telescope relative to the outer tube.

4. The electric-assisted leisure lifting recliner as claimed in claim 1, wherein the base unit includes a transverse beam parallel to a ground, wherein the transverse beam includes two sides, wherein each of the two sides of the transverse beam has a first pivotal portion and a second pivotal portion below the first pivotal portion, wherein the front end of the seat frame includes a third pivotal portion and a fourth pivotal portion, wherein two fifth pivotal portions are provided on two sides of the rear end of the seat frame, wherein a sixth pivotal portion is disposed on an intermediate portion of the rear end of the seat frame, wherein the chassis are fixed to two sides of the seat frame and includes two lateral sides, wherein each of the two lateral sides includes a seventh pivotal portion and an eighth pivotal portion below the seventh pivotal portion, wherein two side boards are respectively provided on two sides of a lower end of the back frame, wherein each of the two side boards includes a front end having a ninth pivotal portion pivotably connected to a respective one of the two fifth connecting portions of the seat frame, wherein a tenth pivotal portion is provided on an in intermediate portion of a lower end of the back frame, wherein the first linking rod includes a rear end having an eleventh pivotal portion and a front end having a twelfth pivotal portion, and wherein the eleventh pivotal portion is pivotably connected to the tenth pivotal portion of the back frame.

5. The electric-assisted leisure lifting recliner as claimed in claim 4, wherein the connecting portion of the footrest unit includes a frame and two second linking rods, wherein a thirteenth pivotal portion and a fourteenth pivotal portion are disposed on a rear end of the frame, wherein the fourteenth pivotal portion is pivotably connected to the fourth pivotal portion of the seat frame, wherein each of the two second linking rods includes two ends respectively and pivotably connected to the third pivotal portion and the supporting portion, wherein the supporting portion includes a linking unit having a rear end pivotably connected to the second linking rod of the connecting portion, wherein when the footrest unit is in the folded state, the connecting portion and the supporting portion are located below the chassis, and wherein when the footrest unit is in the extended state, the connecting portion and the supporting portion are located in front of the seat frame.

6. The electric-assisted leisure lifting recliner as claimed in claim 5, wherein two fifteenth pivotal portions are provided on a rear end of the first frame, wherein two sixteenth pivotal portions are provided on a front end of the first frame, wherein each of the two fifteenth pivotal portions is pivotably connected to a respective first pivotal portion of the base unit, wherein each of the two sixteenth pivotal portions is pivotably connected to a respective seventh pivotal portion, wherein two seventeenth pivotal portions are provided on a rear end of the second frame, wherein two eighteenth pivotal portions are provided on a front end of the second frame, wherein each of the two seventeenth pivotal portions is pivotably connected to a respective second pivotal portion, and wherein each of the two eighteenth pivotal portions is pivotably connected to a respective eighth pivotal portion of the chassis.

7. The electric-assisted leisure lifting recliner as claimed in claim 6, wherein the second frame further includes a nineteenth pivotal portion, wherein the actuating block is mounted below the seat frame unit and in front of the first and second frames, wherein a twentieth pivotal portion is provided on a rear end of the actuating block, wherein a twenty-first pivotal portion, a twenty-second pivotal portion, and a twenty-third pivotal portion are provided on a front end of the actuating block and are arranged from top to bottom in sequence, wherein the twentieth pivotal portion is pivotably connected to the twelfth pivotal portion of the first linking rod of the back frame unit, wherein the twenty-third pivotal portion is pivotably connected to the nineteenth pivotal portion of the second frame, wherein an end of the telescopic rod is pivotably connected to the twenty-first pivotal portion of the actuating block, and wherein another end of the telescopic rod is pivotably connected to the thirteenth pivotal portion.

8. The electric-assisted leisure lifting recliner as claimed in claim 7, wherein the actuator further includes a second end pivotably connected to the sixth pivotal portion of the seat frame, and wherein the first end of the actuator is pivotably connected to the twenty-second pivotal portion of the actuating block.

9. The electric-assisted leisure lifting recliner as claimed in claim 4, wherein each of the two sides of the seat frame includes a peg on a rear end thereof, and wherein each of the two side boards of the back frame includes an arcuate slot receiving a respective peg.

* * * * *